US012753692B2

(12) United States Patent
Garcia et al.

(10) Patent No.: US 12,753,692 B2
(45) Date of Patent: Oct. 6, 2026

(54) SUBSURFACE DETECTION SYSTEM AND METHOD

(71) Applicant: Schlumberger Technology Corporation, Sugar Land, TX (US)

(72) Inventors: German Garcia, Sugar Land, TX (US); Nicholas Fundytus, Edmonton (CA); Hadrien Dumont, Paris (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 7 days.

(21) Appl. No.: 18/940,910

(22) Filed: Nov. 8, 2024

(65) Prior Publication Data

US 2026/0132714 A1 May 14, 2026

(51) Int. Cl.
*E21B 49/08* (2006.01)
*E21B 47/135* (2012.01)

(52) U.S. Cl.
CPC ..... *E21B 49/0875* (2020.05); *E21B 47/135* (2020.05)

(58) Field of Classification Search
CPC ..... E21B 49/0875; E21B 47/135
See application file for complete search history.

(56) References Cited

U.S. PATENT DOCUMENTS 3,369,626 A * 2/1968 Zemanek, Jr. ..... E21B 47/0025 367/68
4,524,436 A * 6/1985 Hall ..... G01L 11/025 367/154
5,671,136 A * 9/1997 Willhoit, Jr. ..... G01V 1/30 702/18
5,877,996 A * 3/1999 Krokstad ..... G01S 15/88 175/45
6,510,104 B1 * 1/2003 Ikegami ..... G01V 1/46 181/102
6,555,807 B2 * 4/2003 Clayton ..... E21B 47/135 250/227.16
6,712,141 B1 * 3/2004 Bussear ..... G01V 11/005 181/102
7,597,142 B2 * 10/2009 Hartog ..... E21B 47/01 166/250.01
8,408,064 B2 * 4/2013 Hartog ..... E21B 47/107 73/643
8,740,455 B2 * 6/2014 Hall ..... G01K 13/10 374/161
8,848,485 B2 * 9/2014 Bostick, III ..... E21B 47/135 181/102
9,109,944 B2 * 8/2015 Den Boer ..... G01H 9/004
9,234,999 B2 * 1/2016 Koelman ..... G02B 6/562
9,255,836 B2 * 2/2016 Taverner ..... G02B 6/02395
9,279,666 B1 * 3/2016 Balasubramaniam ..... G01B 11/18

(Continued)

FOREIGN PATENT DOCUMENTS

WO 2024168259 A1 8/2024

*Primary Examiner* — Steven A Macdonald
(74) *Attorney, Agent, or Firm* — Jeffrey D. Frantz

(57) ABSTRACT

A logging system for a subsurface operation includes: a probe positioned within a wellbore extending through a target formation, the probe generating pressure pulses that propagate within a target formation proximate to the wellbore; and a wireline extending along at least a portion of the wellbore. The wireline detects the pressure pulses and generates an electrical signal indicative of an effective flowing thickness of the target formation.

5 Claims, 6 Drawing Sheets

(56) References Cited

U.S. PATENT DOCUMENTS 9,322,702 B2 * 4/2016 Lumens ..... G01V 1/226
9,377,551 B2 * 6/2016 Hartog ..... G01H 9/004
9,546,548 B2 * 1/2017 Hartog ..... G01V 1/44
9,976,920 B2 * 5/2018 Nunes ..... G01L 1/246
10,247,840 B2 * 4/2019 Skinner ..... G01V 1/226
10,557,959 B2 * 2/2020 Matuszyk ..... G01V 1/50
10,808,522 B2 * 10/2020 Dickenson ..... E21B 47/135
10,975,687 B2 * 4/2021 Langnes ..... G01H 3/04
11,643,923 B2 * 5/2023 Thiruvenkatanathan ..... G01V 1/288 367/86
11,859,485 B1 * 1/2024 Samuel ..... E21B 44/00
12,031,431 B2 7/2024 Valero
12,517,092 B2 * 1/2026 Jones ..... G01N 29/09
2003/0094281 A1 * 5/2003 Tubel ..... G01V 8/16 166/250.03
2004/0017730 A1 * 1/2004 Jackson ..... E21B 47/01 367/25
2006/0133205 A1 * 6/2006 Van Kuijk ..... E21B 47/005 367/35
2007/0044959 A1 * 3/2007 Georgi ..... E21B 23/14 166/250.01
2007/0227774 A1 * 10/2007 Reitsma ..... E21B 44/00 175/25
2009/0114386 A1 * 5/2009 Hartog ..... E21B 41/0064 166/250.01
2009/0182509 A1 * 7/2009 Kimminau ..... E21B 17/0283 702/11
2010/0107754 A1 * 5/2010 Hartog ..... E21B 47/107 73/152.47
2010/0200743 A1 * 8/2010 Forster ..... E21B 47/0224 33/302
2011/0108276 A1 * 5/2011 Spence ..... E21B 34/063 166/308.1
2011/0242936 A1 * 10/2011 Pabon ..... G01V 1/50 367/35
2011/0280103 A1 * 11/2011 Bostick, III ..... G01H 9/004 367/35
2011/0292763 A1 * 12/2011 Coates ..... G01V 1/18 367/25
2012/0139746 A1 * 6/2012 Chen ..... G01V 3/38 340/853.2
2013/0021874 A1 * 1/2013 Hartog ..... G01V 1/226 367/31
2013/0167628 A1 * 7/2013 Hull ..... E21B 47/107 73/152.58
2014/0010045 A1 * 1/2014 Bennett ..... G01V 1/50 367/31
2014/0056111 A1 * 2/2014 Vu ..... E21B 47/005 367/180
2014/0174725 A1 * 6/2014 Dalvi ..... E21B 47/00 166/250.01
2014/0191761 A1 * 7/2014 San Martin ..... G01V 3/20 324/339
2014/0196953 A1 * 7/2014 Chitwood ..... E21B 7/068 175/57
2014/0222343 A1 * 8/2014 Samson ..... G01V 3/12 702/8
2014/0338905 A1 * 11/2014 Ersoz ..... E21B 43/26 166/280.1
2015/0016220 A1 * 1/2015 Bostick, III ..... E21B 47/107 367/25
2015/0107830 A1 * 4/2015 Ersoz ..... G01V 1/02 166/280.1
2015/0135819 A1 * 5/2015 Petrella ..... G01V 1/52 73/152.58
2015/0204184 A1 * 7/2015 Davydov ..... G01V 1/50 367/83
2016/0097871 A1 * 4/2016 Almarhoon ..... E21B 49/003 367/25
2016/0146963 A1 * 5/2016 Hall ..... G01V 1/42 166/250.1
2017/0022806 A1 * 1/2017 Ounadjela ..... G01V 1/46
2017/0031047 A1 * 2/2017 Cheng ..... G01V 1/364
2017/0075000 A1 * 3/2017 Dusterhoft ..... G01V 1/42
2017/0075005 A1 * 3/2017 Ranjan ..... G01V 1/303
2017/0075006 A1 * 3/2017 Dusterhoft ..... G01V 1/303
2017/0123089 A1 * 5/2017 Walters ..... E21B 43/26
2017/0123105 A1 * 5/2017 Quintero ..... G01H 9/004
2017/0276832 A1 * 9/2017 Kouchmeshky ..... E21B 49/00
2017/0292327 A1 * 10/2017 Reckmann ..... E21B 17/10
2017/0328195 A1 * 11/2017 Wilson ..... E21B 7/04
2017/0342822 A1 * 11/2017 Wilson ..... E21B 47/135
2018/0087372 A1 * 3/2018 Stokely ..... G01S 7/56
2018/0100388 A1 * 4/2018 Wilson ..... E21B 47/135
2018/0320505 A1 * 11/2018 Vincelette ..... E21B 47/07
2018/0320509 A1 * 11/2018 Skinner ..... G01V 3/26
2018/0355712 A1 * 12/2018 Nguyen ..... E21B 47/107
2021/0131276 A1 * 5/2021 LeBlanc ..... G01V 1/52
2021/0238980 A1 * 8/2021 Vargo, Jr. ..... E21B 33/16
2021/0277771 A1 * 9/2021 Pawar ..... E21B 47/107
2021/0332683 A1 * 10/2021 Hunter ..... E21B 43/261
2022/0035070 A1 * 2/2022 Laugier ..... G06V 10/751
2022/0074301 A1 * 3/2022 Jaaskelainen ..... E21B 49/087
2022/0127959 A1 * 4/2022 Khalifa ..... E21B 49/005
2023/0228897 A1 * 7/2023 Thompson ..... G01V 1/42
2023/0258065 A1 * 8/2023 Al-Qasim ..... E21B 43/16 166/249
2023/0417114 A1 * 12/2023 Jaaskelainen ..... E21B 47/107
2025/0154861 A1 * 5/2025 Zainalabedin ..... E21B 44/00

* cited by examiner

SUBSURFACE DETECTION SYSTEM AND METHOD

CROSS-REFERENCE TO RELATED APPLICATIONS

None.

TECHNICAL FIELD

The present disclosure relates to subsurface operations, and more particularly to a measurement system for deriving information about a target formation.

BACKGROUND

When making commercial decisions regarding the operation of a well, the permeability and deliverability of the well is critical. Typically, determining the permeability and deliverability of a well involves significant uncertainty. Enabling operators to collect accurate information regarding downhole conditions allows for more effective decision-making which results in increased efficiency and cost savings.

SUMMARY

In one independent aspect, a logging system for a subsurface operation includes: a probe configured to be positioned within a wellbore extending through a target formation, the probe generating pressure pulses that propagate within a target formation proximate to the wellbore; and a wireline configured to extend along at least a portion of the wellbore, the wireline detecting the pressure pulses and generating an electrical signal indicative of an effective flowing thickness of the target formation.

In some aspects, the wireline includes a fiber optic cable.

In some aspects, the wireline detects the pressure pulses by measuring a strain applied to the wireline.

In some aspects, the wireline is configured to translate the strain measured along a length of the wireline into the electrical signal, the electrical signal transmitted to a receiver position on a surface.

In some aspects, the wireline is configured to be positioned within a drill pipe positioned within the wellbore.

In some aspects, the wireline is configured to be positioned within a steel casing lining the wellbore.

In another independent aspect, a logging system for detecting an effective flowing thickness of a subsurface formation includes: a probe configured to be positioned within a wellbore extending through the subsurface formation, the probe configured to generate pressure pulses that propagate within the subsurface formation; and a wireline configured to extend from a surface through at least a portion of the wellbore. The wireline is configured to detect the pressure pulses, measure a strain in a portion of the wireline, and generate an electrical signal indicative of the effective flowing thickness of the subsurface formation based on the measured strain.

In some aspects, the probe is configured to generate pressure pulses on a first side and a second side of a baffle positioned in the subsurface formation.

In some aspects, the wireline is further configured to measure a first strain on a first portion of the wireline positioned adjacent the first side of the baffle and to measure a second strain on a second portion of the wireline positioned on the second side of the baffle.

In some aspects, the first strain and the second strain are compared to determine an impact of the baffle on the effective flowing thickness.

In some aspects, the wireline generates data regarding the duration between the generation of a particular pressure pulse and the detection of that pressure pulse on the second side of the baffle, and wherein said duration informs a determination of the distance by which the baffle extends laterally away from the wellbore.

In some aspects, the probe contains multiple ports.

In some aspects, the probe generates pressure pulses by injecting fluid into the wellbore via the ports.

In some aspects, the probe generates pressure pulses by drawing fluid from the wellbore or from the target formation via the ports.

In some aspects, the wireline transmits an output to the surface, the readout including at least one of (i) an active region corresponding to regions within the target formation that contribute to the effective flowing thickness of the target formation, and (ii) an idle region corresponding to regions within the target formation that do not contribute to the effective flowing thickness of the target formation.

In some aspects, the wireline is configured to transmit an output indicative of an active region in which the baffle is not sufficiently large to impede the flow of fluids from the target formation.

In some aspects, the wireline is configured to transmit an output indicative of an active region and at least one idle region in which the baffle is sufficiently large to impede the flow of fluids from the target formation.

In yet another independent aspect, a method is provided for determining the effective flowing thickness of a target formation in a subsurface operation. The method includes generating a pressure pulse on a first side of a baffle located within the target formation, sensing whether the pressure pulse can be detected on a second side of the baffle positioned opposite the first side, determining that the portion of the target formation located on the second side of the baffle contributes to the effective flowing thickness if the pressure pulse can be detected on the second side of the baffle, and determining that the portion of the target formation located on the second side of the baffle does not contribute to the effective flowing thickness if the pressure pulse cannot be detected on the second side of the baffle.

DETAILED DESCRIPTION

Before any embodiments are explained in detail, it is to be understood that the disclosure is not limited in its application to the details of the configuration and arrangement of components set forth in the following description or illustrated in the accompanying drawings. The disclosure is capable of being practiced or of being carried out in various ways. Also, it is to be understood that the phraseology and terminology used herein are for the purpose of description and should not be regarded as limiting. The use of "including," "comprising," or "having" and variations thereof are meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings.

Figure 1:
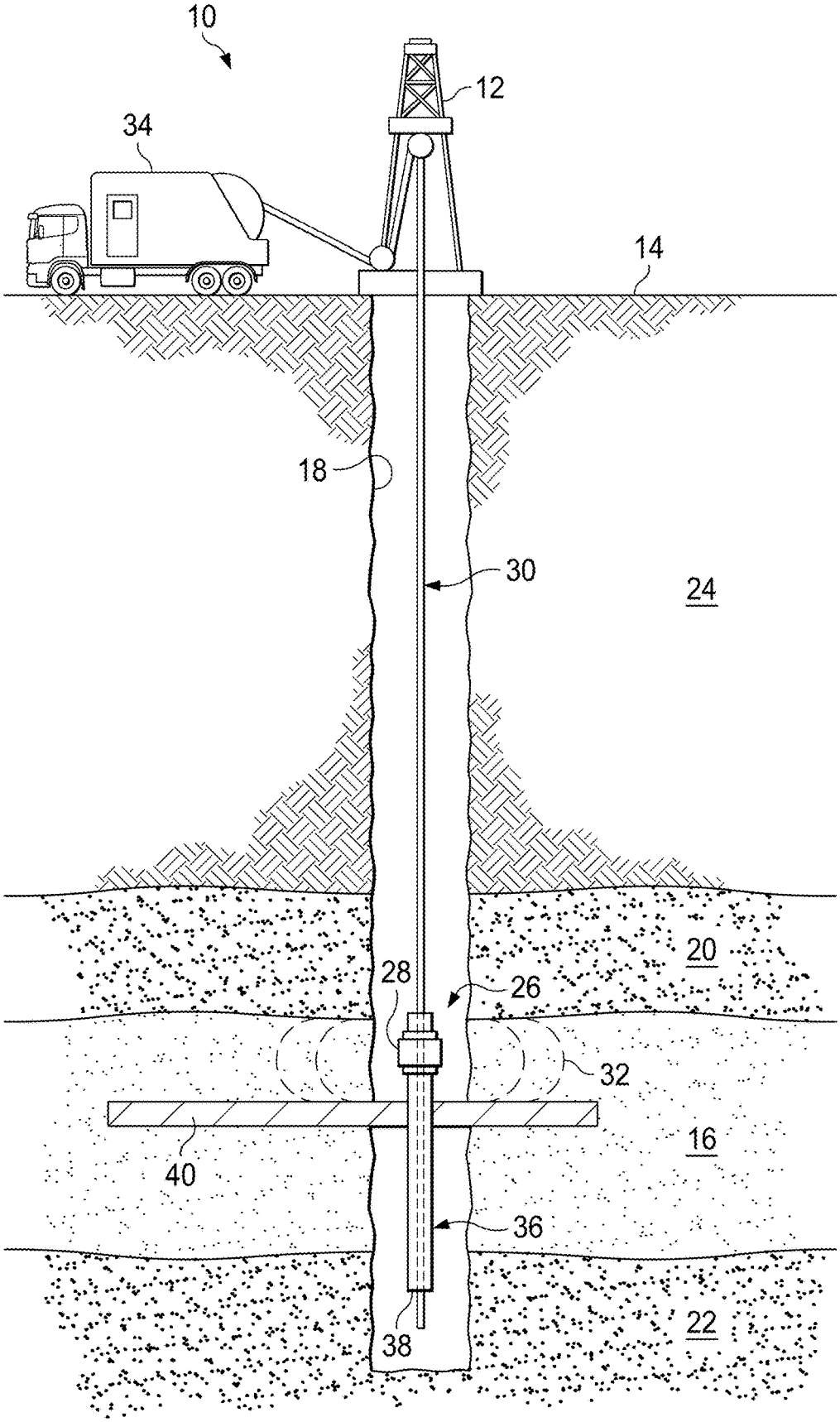
FIG. 1 illustrates a schematic view of a first exemplary subsurface operation.

FIG. 1 depicts a subsurface energy operation, for example, a well testing operation 10. A derrick 12 at a surface 14 is positioned over a target formation 16 (e.g., a reservoir). A wellbore 18 begins at the surface 14 and extends through one or more strata of rock or soil including the target formation 16. For example, the target formation 16 may be adjacent to an upper boundary layer 20 positioned above the target formation 16 and a lower boundary layer 22 positioned below the target formation 16. Additionally, a superjacent layer 24 may be positioned between the upper boundary layer 20 and the surface 14. As shown in FIG. 1, the wellbore 18 may extend through one or more of the superjacent layer 24, the upper boundary layer 20, the target formation 16, and the lower boundary layer 22. In other embodiments, the wellbore 18 may extend through or be positioned proximate to additional or alternative strata as compared to those depicted in FIG. 1.

The target formation 16 may include sedimentary rock such as sandstone, limestone, or another porous and/or permeable material. For example, the target formation 16 may be a "reservoir" which is sufficiently porous to hold fluids and sufficiently permeable to allow the fluids to flow. On the other hand, the upper boundary layer 20, lower boundary layer 22, and/or superjacent layer 24 may be formed from an impermeable rock or other material that prevents or hinders the flow of fluids, such as shale or other impermeable materials.

A logging system 26 provides data regarding the physical characteristics of the target formation 16. For example, the logging system 26 may be configured to measure or estimate characteristics, such as an effective flowing thickness, of the target formation 16. The logging system 26 may include a probe 28 and a wireline 30. In the illustrated embodiment, the probe 28 is positioned proximate a bottom of the wellbore 18; however, in other embodiments, the probe 28 may be positioned in another location. The probe 28 may be configured to generate pressure pulses 32 that propagate through the surrounding strata, and the wireline 30 may be configured to observe or detect the effect of the pressure pulses 32 such that information about the geological features and/or characteristics of the strata proximate to the wellbore 18 (e.g., the target formation 16) may be derived. The logging system 26 includes at least the probe 28 and the wireline 30 and may be utilized to obtain or derive downhole information in a variety of subsurface applications including carbon capture, utilization, and storage (CCUS), geothermal energy production and storage, oil and gas exploration and production, enhanced oil recovery, aquifer management, and the like.

The wireline 30 may be configured to detect the pressure pulses 32 generated by the probe 28 and transmit data regarding the pressure pulses to the surface 14. For example, the wireline 30 may be provided in the form of a fiber optic cable or a cemented fiber cable configured to transmit electrical signals, or the wireline 30 may be provided in another suitable form. The wireline 30 may be configured to detect a localized pressure within the target formation 16 by measuring a strain applied to the wireline 30 at a given moment in time (e.g., strain caused by compression or distortion of the wireline 30 as the pressure pulses 32 propagate). In some embodiments, the wireline 30 may be stored at the surface 14 (e.g., on a reel of a logging truck 34), and a computer or other piece of equipment may receive and interpret data from the wireline 30. In other embodiments, the wireline 30 may be retained and deployed in another manner.

In some embodiments, additional testing equipment 36 may be positioned at a distal end 38 of the wireline 30 such that the testing equipment 36 may be lowered into the wellbore 18 from the surface 14. The testing equipment 36 may include a telemetry unit, sample carrier, fluid analyzer, pumps, and/or any other known well logging tool configured to detect or measure various properties of the target formation 16 such as pressure, permeability, thickness, and fluid composition.

Figure 2:
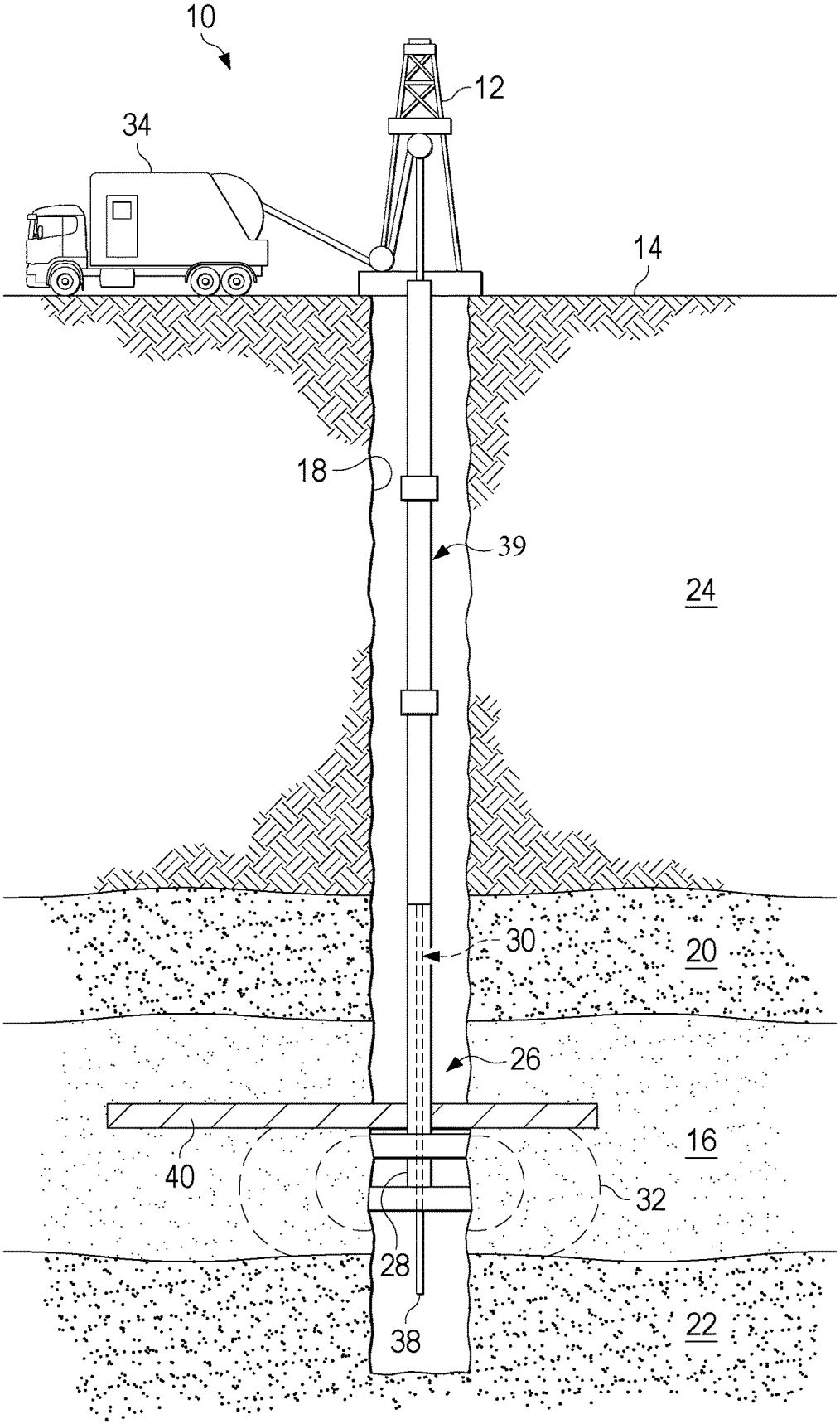
FIG. 2 illustrates a schematic view of a second exemplary subsurface operation.

As shown in FIG. 2, the wireline 30 may be at least partially encased within a drill string 39 positioned within the wellbore 18. The drill string 39 may be provided in the form of a substantially cylindrical structure beginning at or just above the surface 14 and extending downwardly into the wellbore 18. The drill string 39 may be utilized in tough logging conditions (TLC) operations where the well testing operation 10 is performed under challenging conditions such as high pressures, high temperatures, or highly deviated or horizontal wellbores 18. Thus, the drill string 39 may protect the wireline 30 and/or other components of the well testing operation 10 from environmental damage. The wireline 30 may extend through the drill string 39 such that at least a portion of the wireline 30 is positioned downhole with respect to the probe 28.

Figure 3:
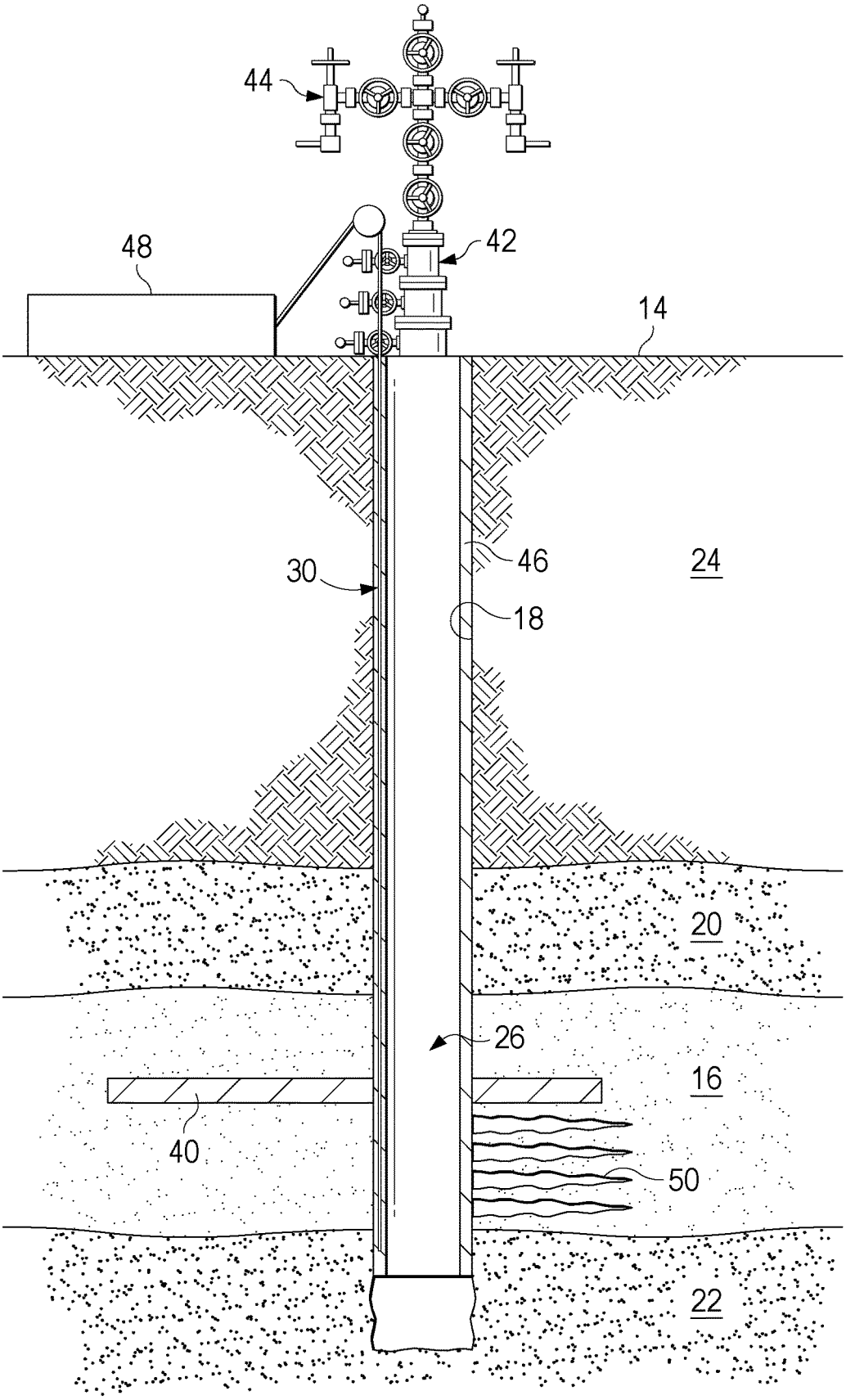
FIG. 3 illustrates a schematic view of a third exemplary subsurface operation.

Additionally, as shown in FIG. 3, the logging system 26 may be utilized during well production and/or injection operations. For example, in place of the derrick 12 shown in FIGS. 1 and 2, a wellhead 42 and a tree 44 may be positioned atop the wellbore 18 (e.g., at the surface 14) and configured to distribute one or more flows of fluids into or out of the wellbore 18. The wellbore 18 may be lined with a steel casing 46 designed to support the wellbore 18 (e.g., by imparting structural rigidity thereto). The wireline 30 may be embedded within or otherwise connected to the steel casing 46 rather than being deployed independently into the wellbore 18. The wireline 30 may be in communication with a readout box 48 positioned at the surface 14 (e.g., the wireline 30 may be configured to transmit electrical signals to the readout box 48). As shown, one or more perforations 50 may be formed in the target formation, for example, by lowering targeted charges into the wellbore and detonating said charges such that the blast creates the perforation 50. The perforations 50 may be substantially perpendicular with respect to the wellbore 18, or the perforations 50 may be oriented at an angle with respect to the wellbore 18.

The target formation 16 may include one or more baffles 40. The baffle 40 is a geological feature or formation positioned or embedded within the target formation 16 that may impede the flow of fluids within or through the target formation 16. The presence of the baffle 40 may affect the overall performance (e.g., permeability or deliverability) of the target formation. For example, the baffle 40 may be a layer of shale, mudstone, or another low-permeability layer embedded within the target formation 16. The baffle 40 may be imparted with any shape or size and understanding the positioning and characteristics of the baffle 40 is critical for accurate reservoir modeling and operational planning.

The presence of even a single baffle 40 may impact the effective flowing thickness of the target formation 16. For example, the baffle 40 may create a boundary for the effective flowing thickness, thereby limiting the performance of the target formation 16. If the baffle 40 is not of a sufficient size (e.g., if the baffle 40 extends laterally away from the wellbore 18 by tens of meters in length), fluids may be capable of flowing around the baffle 40 and the performance of the target formation 16 may not be substantially affected. In other words, the effective flowing thickness of the target formation may extend entirely between the upper boundary layer 20 and the lower boundary layer 22.

However, if the baffle 40 is sufficiently large, it may impede the flow of fluids within and through the target formation 16 such that the effective flowing thickness of the target formation 16 is reduced. For example, in such a case, the effective flowing thickness of the target formation 16 may extend between the baffle 40 and the upper boundary layer 20 or between the baffle 40 and the lower boundary layer 22. As described in detail below with reference to FIGS. 4-6, the logging system 26 may be configured to provide data that can be interpreted to determine one or more characteristics of the baffle 40 (and/or other baffles 40 not shown) and can thus inform reservoir modeling and operational decisions (e.g., by informing a determination of the effective flowing thickness of the target formation 16).

Figure 4:
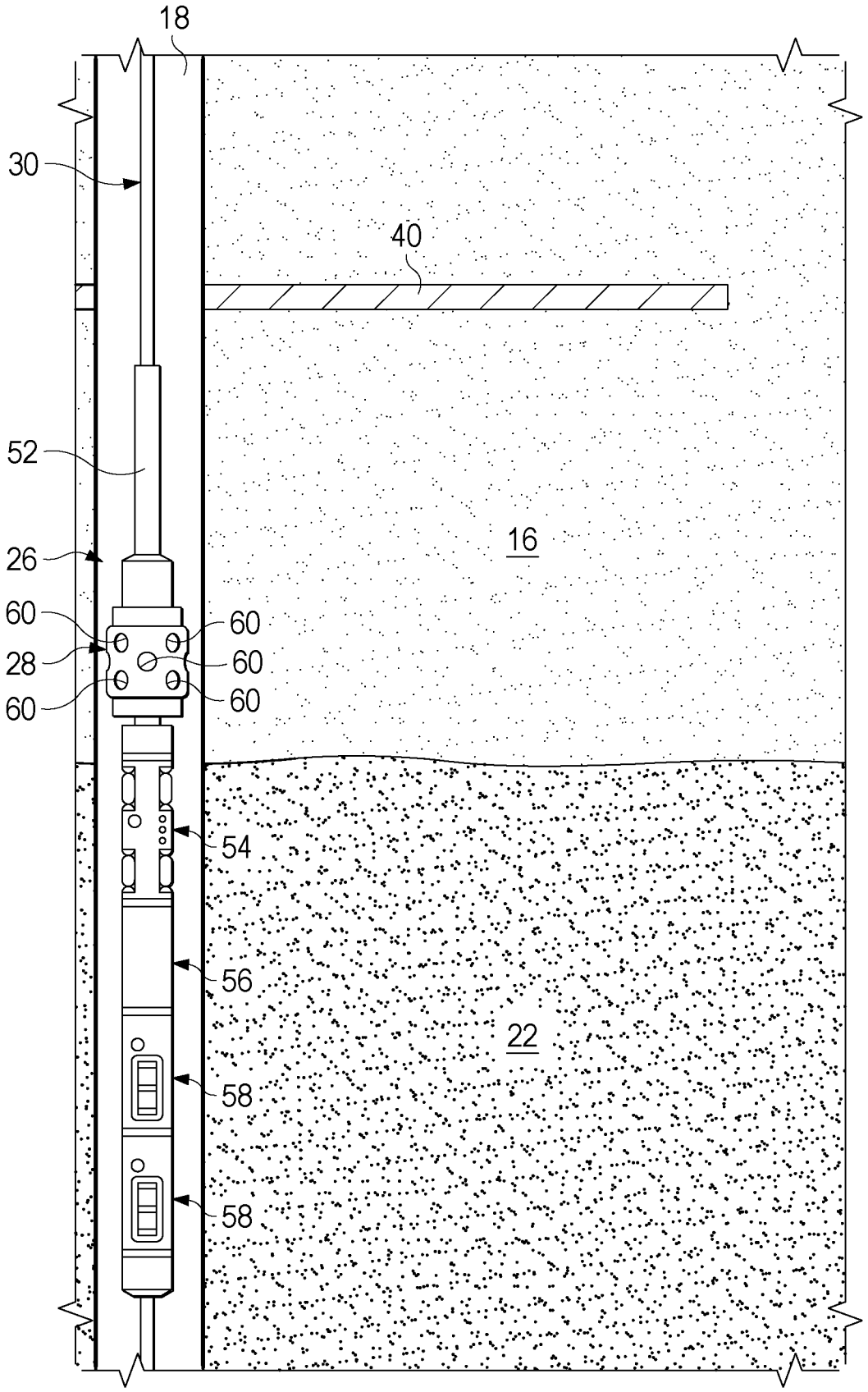
FIG. 4 illustrates a schematic view of a logging system according to the principles of the present disclosure for use in the subsurface operations of FIGS. 1-3 in an idle state.
Figure 5:
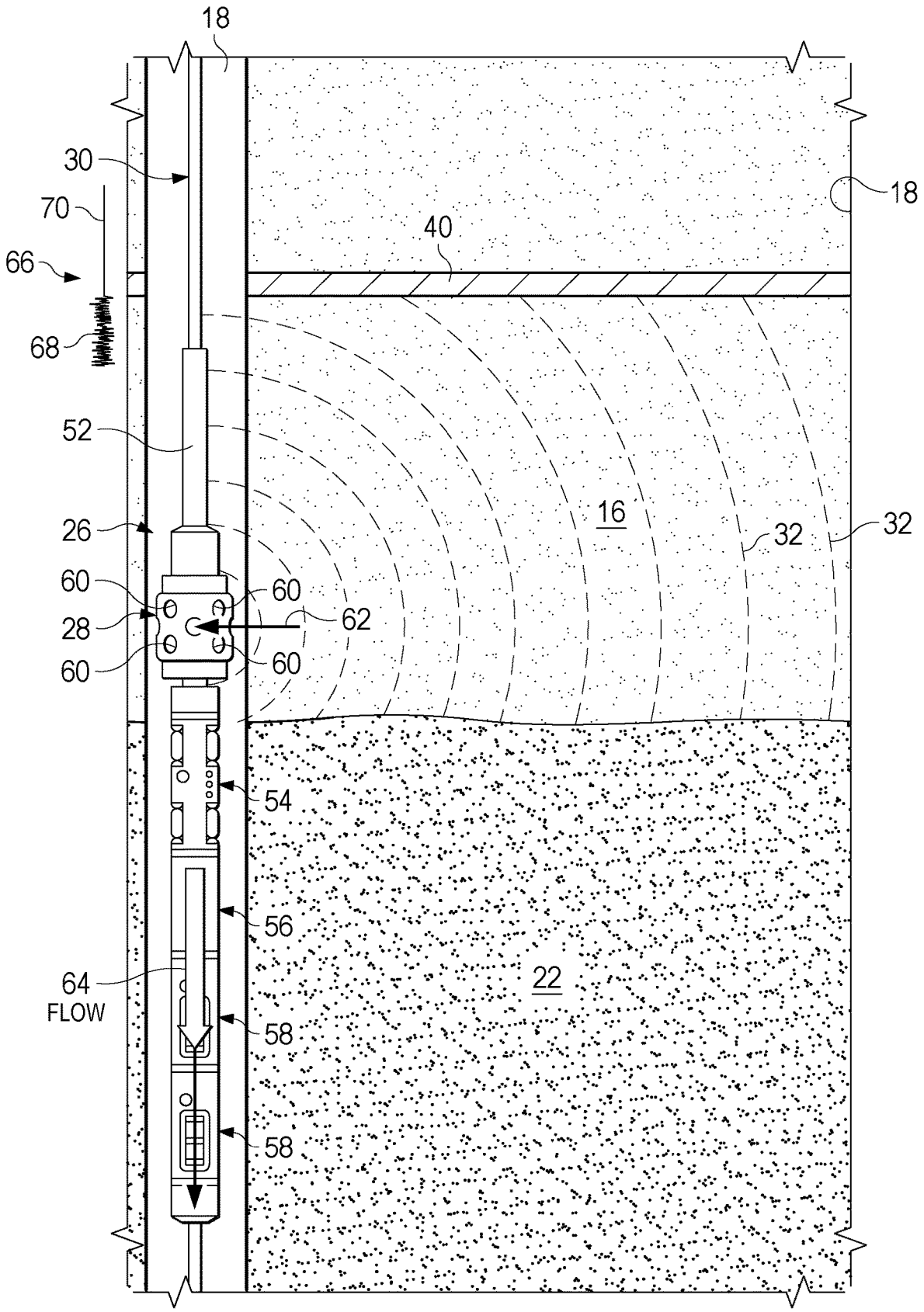
FIG. 5 illustrates a schematic view of the logging system of FIG. 4 in a first mode of operation.
Figure 6:
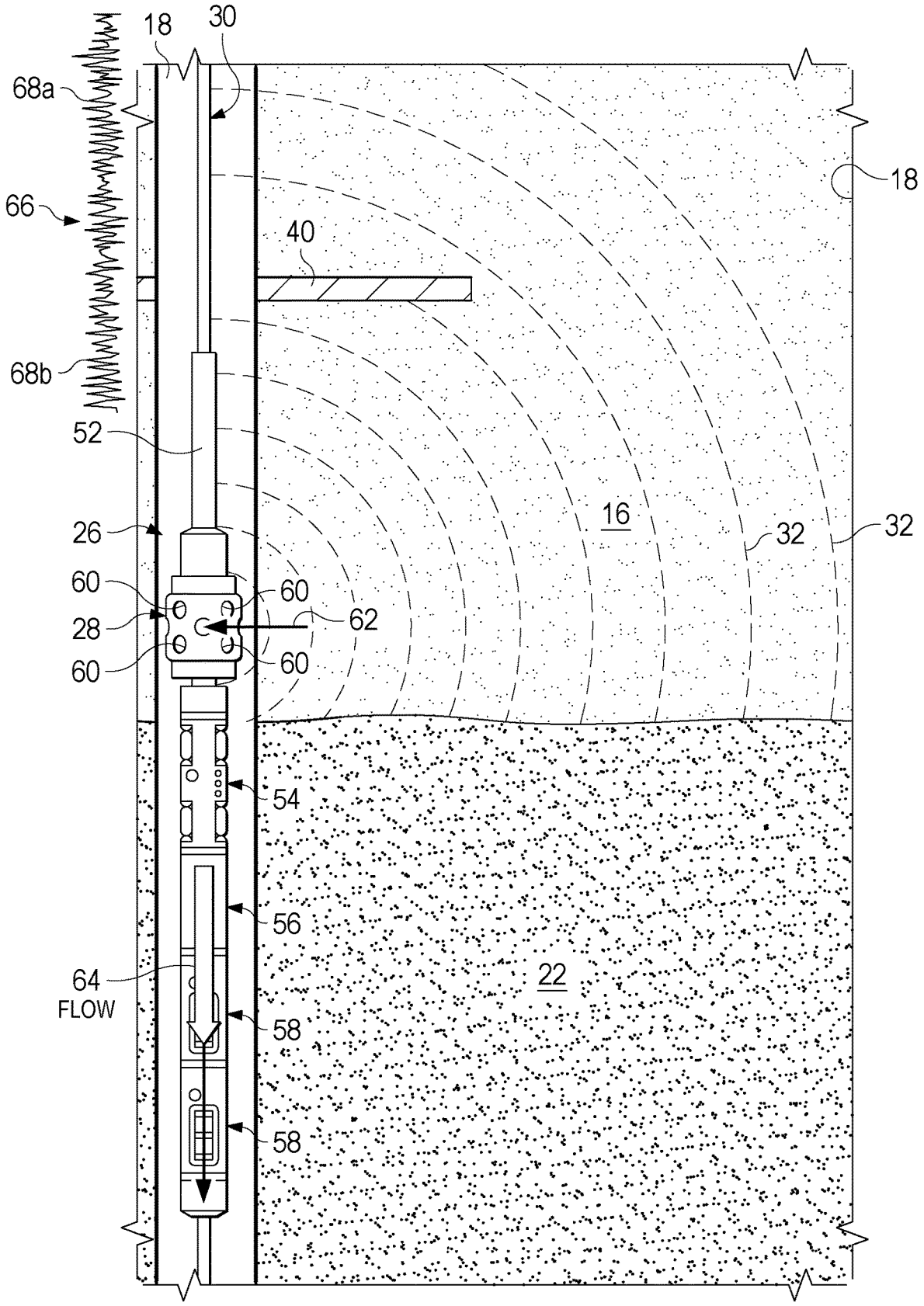
FIG. 6 illustrates a schematic view of the logging system of FIG. 4 in a second mode of operation.

FIGS. 4-6 provide a more detailed depiction of the logging system 26 in operation. The logging system 26 may include a telemetry unit 52 configured to transmit real-time data to the surface 14 (e.g., regarding downhole pressure, temperature, drilling dynamics, or other characteristics). A sample carrier 54 may be provided to isolate a sample of, for example, the fluids extracted from the target formation 16 for analysis. In some cases, the logging system 26 also includes a fluid analyzer 56 configured to analyze the sampled fluids. The logging system 26 may further include one or more pumps 58 configured to drive the circulation of fluid within the wellbore 18.

The probe 28 may be configured to generate a pressure pulse 32 (see FIGS. 5 and 6), or a series of pressure pulses 32, by either (i) injecting fluid into the wellbore 18 to create a localized increase in pressure or (ii) drawing fluid from the target formation 16 and/or the wellbore 18 to create a localized decrease in pressure. In some embodiments, the probe 28 may include a plurality of ports 60 designed to facilitate fluid communication with the wellbore 18 such that the probe 28 is capable of injecting or drawing fluid in order to create the pressure pulses 32. For example, in some embodiments (e.g., in a production context), hydrocarbons may flow from the target formation 16 into the probe 28 via the ports 60 as indicated by a first arrow 62. The hydrocarbons may then flow downhole, as indicated by a second arrow 64, before being returned to the surface 14 (FIG. 1).

As shown in FIGS. 5 and 6, the wireline 30 is configured to detect the pressure pulses 32 generated by the probe 28 and produce a readout 66 that can be transmitted to the surface via the wireline 30 for analysis. For example, the readout 66 may be transmitted to and displayed by a screen or device aboard the logging truck 34 (FIGS. 1 and 2), by the readout box 48 (FIG. 3), or by another device. In the illustrated embodiment, the readout 66 may be a plot of the fluctuation of the pressure detected within the target formation 16 at various points along the length of the wireline 30. In other embodiments, the readout 66 may be provided in another form provided that the readout 66 reflects the propagation of the pressure pulses 32 within the target formation 16.

In FIG. 5, the baffle 40 is sufficiently large to impede the flow of fluids and act as a boundary to the effective flowing thickness of the target formation 16. Thus, the pressure pulses 32 may be blocked by the baffle 40 (e.g., the pressure pulses 32 may be unable to travel around the baffle 40) such that the pressure pulses 32 emanate throughout the portion of the target formation 16 positioned beneath the baffle 40 but are unable to reach the portion of the target formation 16 positioned above the baffle 40. Accordingly, the wireline 30 only detects the pressure pulses 32 on one side of the baffle 40 (e.g., the side of the baffle 40 where the probe 28 is positioned). As a result, the readout 66 may include an active region 68 and an idle region 70. The active region 68 may include a series of peaks and troughs that are indicative of fluctuations in the strain detected along the portion of the wireline 30 located beneath the baffle. The idle region 70 may have a substantially flat shape indicative of the failure to detect fluctuations in the strain detected along the portion of the wireline 30 located above the baffle 40.

The configuration of FIG. 6 is substantially the same as in FIG. 5, except that the baffle 40 is not sufficiently large to impede the flow of fluids and act as a boundary to the effective flowing thickness of the target formation. Thus, as shown, the pressure pulses 32 generated by the probe 28 are able to travel around the baffle 40 and may propagate through regions of the target formation 16 located on both sides of the baffle 40. As a result, the wireline 30 may detect the pressure pulses 32 (e.g., by measuring a strain) both above and below the baffle 40 such that the readout 66 does not include the idle region 70 shown in FIG. 5. Instead, for example, the readout 66 may include a first active region **68*a* positioned above the baffle 40 and a second active region 68*b* positioned below the baffle 40**.

Thus, as illustrated in FIGS. 5 and 6, the nature of the readout 66 that results when pressure pulses 32 are generated within the target formation 16 may provide operators with information regarding the characteristics of the target formation 16 and any possible baffles 40 located therein. In particular, the logging system 26 may provide data that informs a determination of the effective flowing thickness of the target formation 16. When the target formation 16 includes one baffle 40, as in the exemplary configuration depicted in the figures, the readout 66 may inform a determination of whether the effective flowing thickness of the target formation 16 includes the entirety of the target formation 16 or is limited by the baffle 40.

For example, if the probe 28 is operated to send pressure pulses 32 through the target formation 16 and the resulting readout 66 includes an idle region 70 as shown in FIG. 5, an operator may determine that the target formation 16 includes a baffle 40 of sufficient size to impede the flow of fluids therefrom and that the idle region 70 corresponds to a region within the target formation 16 where fluids may be prevented from flowing. Accordingly, the baffle 40 may be treated as a boundary to the effective flowing thickness of the target formation 16 when making operational decisions. In such cases, the effective flowing thickness may be considered to extend between the baffle 40 and the upper boundary layer 20 or between the baffle 40 and the lower boundary layer 22 (FIG. 1), depending on the location of the idle region 70.

On the other hand, if the probe 28 is operated to send pressure pulses 32 through the target formation 16 and the resulting readout 66 does not include an idle region 70 (e.g., the readout 66 consists of active regions 68*a*, 68*b* above and below the baffle 40, as shown in FIG. 6), an operator may determine that the target formation 16 does not include a baffle 40 of sufficient size to impede the flow of fluids. Accordingly, the baffle 40 is not treated as a boundary to the effective flowing thickness of the target formation 16, and the effective flowing thickness may extend between the upper boundary layer 20 and the lower boundary layer 22 (FIG. 1). In other words, the effective flowing thickness may include the entirety of the target formation 16.

In other embodiments, the target formation 16 may include any number of baffles 40, and the baffles 40 may be imparted with different sizes and/or other characteristics. In such cases, the readout 66 produced by the logging system 26 may inform the determination of the effective flowing thickness in a similar manner as described above with respect to the single-baffle embodiment depicted in the figures. For example, the baffles 40 may interfere with the pressure pulses 32 such that the readout 66 contains multiple active regions 68 and/or multiple idle regions 70. Portions of the length of the wireline 30 that produce active regions 68 in the readout 66 may be considered to correspond to regions of the target formation 16 that contribute to the effective flowing thickness. On the other hand, portions of the length of the wireline 30 that produce idle regions 70 in the readout 66 may be considered to correspond to regions of the target formation 16 that do not contribute to the effective flowing thickness.

Moreover, in the configuration depicted in FIGS. 5 and 6, one probe 28 is positioned below the baffle 40 and produces the pressure pulses 32. Thus, when the baffle 40 is large enough to impede the flow of fluids, the portion of the wireline 30 positioned below the baffle 40 may detect the pressure pulses 32, but the portion of the wireline 30 positioned above the baffle 40 may fail to detect the pressure pulses 32. In other embodiments, other configurations are possible including any number of probes 28. The probes 28 may be positioned in any suitable manner within the wellbore 18 (e.g., above the baffle 40, below the baffle 40, or both). For example, when the target formation 16 is believed to contain multiple baffles 40, one or more probes 28 may be selectively positioned within the target formation 16 in order to obtain data probative of the relevant characteristics of the target formation 16 and/or the baffles 40. In general, if a pressure pulse 32 is created on one side of a particular baffle 40 and can be detected by the wireline 30 on the opposite side of the baffle 40, an operator may determine that that baffle 40 is not sufficiently large to impede the flow of fluids and affect the effective flowing thickness of the target formation 16.

In addition to the binary determination regarding whether the baffle 40 is sufficiently large to limit the effective flowing thickness of the target formation 16, the logging system 26 may be capable of providing information regarding the relative size of the baffle. For example, the length of the baffle 40 (e.g., the distance by which the baffle 40 extends laterally away from the wellbore 18) may be proportional to the amount of time it takes a pressure pulse 32 generated by the probe 28 on one side of the baffle 40 to be detected by the wireline 30 on the other side of the baffle 40. In this way, an operator may derive information regarding the size of the baffle 40 by observing the time that passes between the generation of a pressure pulse 32 and the detection of that pressure pulse 32 on the opposite side of the baffle 40 relative to where the pressure pulse 32 was generated.

In other embodiments, other configurations are possible. For example, those of skill in the art will recognize, according to the principles and concepts disclosed herein, that various combinations, sub-combinations, and substitutions of the components discussed above can provide a mud pulse telemetry system.

The embodiment(s) described above and illustrated in the figures are presented by way of example only and are not intended as a limitation upon the concepts and principles of the present disclosure. As such, it will be appreciated that variations and modifications to the elements and their configuration and/or arrangement exist within the spirit and scope of one or more independent aspects as described.

What is claimed is:

1. A logging system for a subsurface operation, the logging system comprising:

a probe configured to be positioned within a wellbore extending through a target formation, the probe further configured to generate pressure pulses to propagate within the target formation proximate to the wellbore by injecting fluid into the wellbore;

a wireline configured to: extend along at least a portion of the wellbore; detect the pressure pulses by measuring a strain caused by compression of the wireline as the pressure pulses propagate through the target formation; and generate a signal indicative of an effective flowing thickness of the target formation, the wireline comprising a fiber cable configured to transmit the signal; and testing equipment coupled to the wireline and configured to detect permeability and fluid composition of the target formation.

2. The logging system of claim 1, wherein the wireline is further configured to detect the pressure pulses by measuring the strain applied to the wireline.

3. The logging system of claim 2, wherein the wireline is further configured to: translate the strain measured along a length of the wireline into the signal; and transmit the signal to a receiver position on a surface.

4. The logging system of claim 1, wherein the wireline is further configured to be positioned within a drill pipe positioned within the wellbore.

5. The logging system of claim 1, wherein the wireline is further configured to be positioned within a steel casing lining the wellbore.

* * * * *